US005572135A

United States Patent [19]

Owens et al.

[11] Patent Number: 5,572,135

[45] Date of Patent: Nov. 5, 1996

[54] DIAGNOSTIC APPARATUS AND METHODS FOR IGNITION CIRCUITS

[75] Inventors: David N. Owens, Smithville Flats; Dale F. Geislinger, Norwich, both of N.Y.

[73] Assignee: Simmonds Precision Engine Systems, Akron, Ohio

[21] Appl. No.: 606,694

[22] Filed: Feb. 26, 1994

Related U.S. Application Data

[63] Continuation of Ser. No. 173,596, Dec. 27, 1993.

[51] Int. Cl.[6] ..... F02P 3/02; F02P 3/06

[52] U.S. Cl. ..... 324/380; 324/382

[58] Field of Search ..... 324/390, 380, 324/382, 384, 502, 536, 393, 399; 307/10.6

[56] References Cited

U.S. PATENT DOCUMENTS

| | | | |
|---|---|---|---|
| 2,645,751 | 7/1953 | Byerlay | 324/15 |
| 3,324,393 | 6/1967 | Casey et al. | 324/96 |
| 3,793,584 | 2/1974 | Liebermann et al. | 324/16 R |
| 4,558,280 | 12/1985 | Koehl et al. | 324/399 |
| 4,799,005 | 1/1989 | Fernandes | 324/127 |
| 4,825,167 | 4/1989 | Bayba | 324/399 |
| 5,065,073 | 11/1991 | Frus | 315/209 R |
| 5,111,790 | 5/1992 | Grandy | 324/380 |
| 5,155,437 | 10/1992 | Frus | 324/399 |
| 5,216,369 | 6/1993 | Toyama | 324/393 |
| 5,237,279 | 8/1993 | Shimaski et al. | 324/399 |
| 5,317,267 | 5/1994 | Miyata et al. | 324/402 |
| 5,334,938 | 8/1994 | Kugler et al. | 324/399 |
| 5,343,154 | 8/1994 | Frus | 324/380 X |
| 5,365,910 | 11/1994 | Miyata et al. | 324/399 |

FOREIGN PATENT DOCUMENTS

| | | |
|---|---|---|
| 2105042 | 3/1994 | Canada . |
| 2083308A | 3/1982 | European Pat. Off. . |
| 0362014 | 4/1990 | European Pat. Off. . |
| 0468253A3 | 1/1992 | European Pat. Off. . |
| 693911 | 4/1930 | France . |
| 1046501 | 7/1953 | France . |
| 1227731 | 10/1966 | Germany . |
| 3735234A1 | 4/1989 | Germany . |
| 4132285A1 | 9/1992 | Germany . |

OTHER PUBLICATIONS

Copy of European Search Report dated Mar. 31, 1995 For European Application No. 94309738 6.

Copy of European Search Report dated Apr. 3, 1995 For European Application No. 94305210 0.

Abstract for Japanese Patent No. 4298685.

*Primary Examiner*—Sandra L. O'Shea
*Assistant Examiner*—Roger Phillips
*Attorney, Agent, or Firm*—Leonard L. Lewis; William E. Zitelli

[57] ABSTRACT

Diagnostics apparatus for detecting operation of an exciter circuit connected to an igniter, includes means for detecting current discharged from the exciter circuit through the igniter, means for detecting current discharged from the exciter circuit other that through the igniter, and means for producing a single output that indicates the type of discharge from the exciter circuit.

17 Claims, 2 Drawing Sheets

DIAGNOSTIC APPARATUS AND METHODS FOR IGNITION CIRCUITS

This is a file wrapper continuation of application Ser. No. 08/173,596, filed Dec. 27, 1993.

BACKGROUND OF THE INVENTION

The invention relates generally to ignition systems, and more particularly to apparatus and methods for detecting and indicating the occurrence and type of discharges from an exciter circuit.

Conventional ignition systems are well known and typically include an exciter circuit having an energy storage device such as a capacitor and a circuit for charging the capacitor, one or more igniter plugs circuit, and a switching mechanism as part of a discharge circuit connected between the capacitor and the igniter. In aerospace applications, the switching mechanism commonly is a spark gap, or more recently solid state switches such as SCRs. A control circuit can be provided to control when the switching mechanism is triggered so that the energy stored in the capacitor can be discharged across the igniter plug. During the time that the switching device is open, the capacitor is charged by the charging circuit. The control circuit may include a timer circuit to control the spark rate.

It is often desirable to know whether the ignition system is operating properly, particularly to know if the spark rate is being maintained. For example, spark rates can be significantly affected by operating temperature excursions or variations of input voltage or frequency. Also, various failure modes within the discharge circuits can prevent proper discharge of current through the igniter. Accordingly, many ignition diagnostic systems use a current transformer to detect discharge, typically through the high tension lead or return lead. The current transformer includes a wire coil on a high permeability core that surrounds the current lead. Discharge current through the ignition system cables induces a current in the transformer that can then be detected by the diagnostic system because the induced current is related to the occurrence of a discharge current. The current transformer, therefore, provides a way to detect the occurrence of a discharge.

However, such discharge detection schemes essentially operate as a go/no-go type diagnostic signal. The signal can indicate whether a spark discharge occurred or not, but cannot provide any further information as to what may have caused the igniter not to fire.

In many aerospace applications, more than one exciter circuit may be used per engine for ignition. In such circumstances, a simple go/no-go type diagnostic signal does not provide sufficient information when a spark discharge fails to occur.

Although multiple diagnostic signals could be used, this approach is unacceptable in modern engines because of the added wiring and weight. Multiple diagnostic signals also increase the complexity of the electronics needed to interpret the diagnostic signals.

The objectives exist, therefore, for apparatus and methods for producing diagnostic signals that can indicate whether exciter circuit discharges occur and the nature of the discharges. Such apparatus and methods preferably should produce such diagnostic signals using a single diagnostic output to simplify monitoring the signals.

SUMMARY OF THE INVENTION

To the accomplishment of the foregoing objectives, the present invention contemplates, in one embodiment, apparatus for detecting operation of an exciter circuit connected to an igniter, comprising: means for detecting discharge from the exciter circuit through the igniter, means for detecting discharge from the exciter circuit other than through the igniter, and means for producing a single output that indicates the type of discharge from the exciter circuit.

The invention also contemplates the methods embodied in the use of such apparatus, as well as a method for monitoring exciter circuit operation for an exciter circuit connected to an igniter, comprising the steps of:

a. detecting discharge from the exciter circuit through the igniter;

b. detecting discharge from the exciter circuit other than through the igniter; and c. producing a single diagnostic output that indicates occurrence of said discharge events.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION

Figure 1:
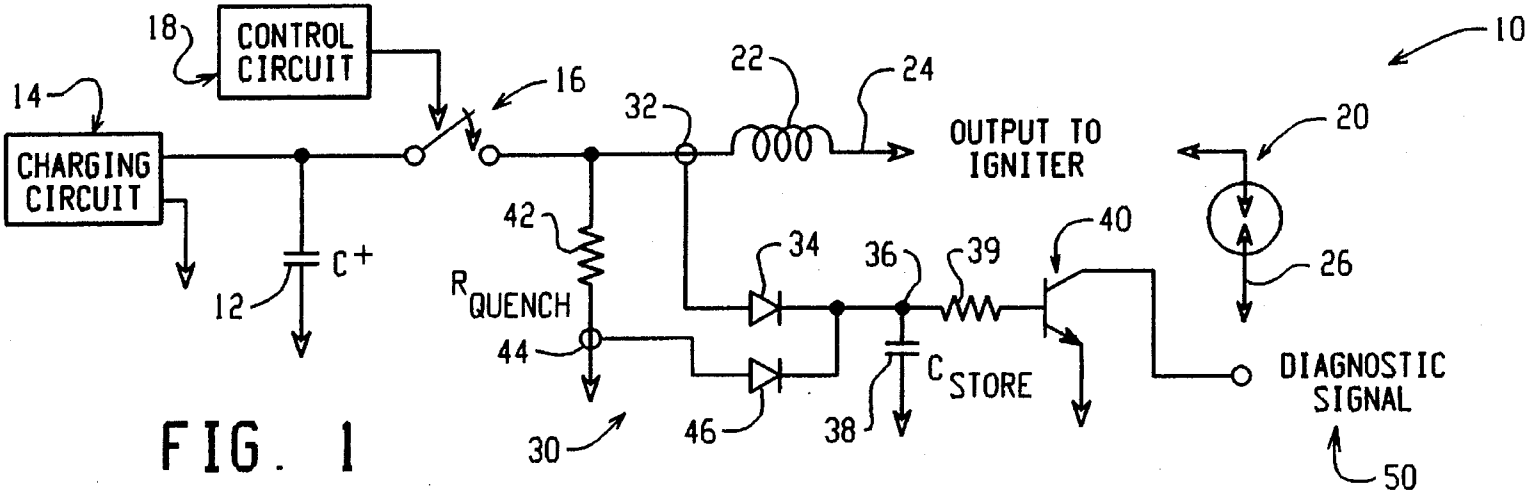
FIG. 1 is an electrical schematic of an exemplary exciter circuit with a diagnostics apparatus according to the invention.

With reference to FIG. 1, an embodiment of a diagnostics apparatus according to the present invention shown in an exemplary combination with an exciter circuit is generally indicated with the numeral 10. Although the invention is described herein with respect to specific embodiments in combination with specific types of ignition systems, this description is intended to be exemplary and should not be construed in a limiting sense. Those skilled in the art will readily appreciate that the advantages and benefits of the invention can be realized with many different types of ignition systems and exciter circuit designs including, but not limited to, unidirectional discharge, oscillatory discharge, AC and/or DC charging systems, capacitive and other discharge configurations, periodic and single shot rocket) ignition systems, spark gap and solid-state switching circuits, high tension and low tension discharge circuits, and so on, to name just a few of the many different ignition systems. Furthermore, the invention can be used with ignition systems for many different types of engines, although the description herein is with specific reference to use with a gas turbine engine ignition system.

An exemplary low tension exciter circuit is shown in FIG. 1, and includes a main storage capacitance 12 ($C^+$) that is connected to a charging circuit 14. The charging circuit 14 can be an AC or DC charger depending on the particular requirements for each application. The charging circuit design can be conventional, such as a DC inverter or a continuous AC supply circuit, for example. The capacitance 12 is also connected to one side of a switch mechanism 16 which for clarity is shown in a representative manner. The switching mechanism can be realized in the form of a spark gap, a gated spark gap, gated solid state switches such as SCR, GTO or MCT devices, either single or cascaded, and so on.

The ignition system exciter circuit 10 may include a control circuit 18 that triggers the switch mechanism 16 at the appropriate times to produce a desired spark rate. For example, the control circuit can trigger the switch 16 closed after the capacitance 12 reaches a predetermined charge level; or alternatively, for example, the control circuit 18 can trigger the switch 16 at a predetermined rate based on the desired spark rate. Other timing control scenarios can be used, of course, and the particular control circuit design will depend on the timing function to be generated, as is well known to those skilled in the art.

The switching mechanism 16 is also connected to a pulse shaping and output circuit which in this case includes an inductor 22. In this exemplary circuit, the discharge current produced when the capacitance 12 discharges through the igniter will be an oscillatory discharge current, such as is typical when spark gap trigger devices are used as the switching mechanism 16. A free wheeling diode (not shown) can be used to produce non-oscillatory unidirectional discharge currents if desired, such as are commonly used with solid state switching devices.

The inductor 22 is also connected to the igniter 20 (also shown in a representative manner) and functions to limit the initial current surge through the switch to protect, for example, solid state switches. The output inductor 22 is typical in a low tension exciter circuit. Other pulse shaping circuits are well known, such as current and/or voltage step-up circuits and distributed or multiplexed output controls, just to name a few examples.

The exciter circuit typically is connected to the igniter 20 by a conductor, such as a high voltage/current cable lead 24 and a return lead 26. In operation, when the switching mechanism closes after the capacitor is charged, the capacitor voltage is impressed across the igniter gap. Assuming the voltage across the plug gap exceeds the breakover voltage of the gap, a plasma or similar conductive path jumps the gap and the capacitor quickly discharges with current rising rapidly. Typical discharge times are on the order of several microseconds. Typical breakover voltages for a low tension circuit are on the order of 3000 VDC with a discharge current of about 700 amps.

In accordance with the invention, the diagnostic apparatus is generally identified with the numeral 30, and includes a discharge current pulse detection device 32, such as a conventional current transformer. The current discharge pulse through the igniter can be detected at various points in the ignition circuit. In this case, the detector circuit is shown in use detecting the current through a conductor that connects the inductor to the switch. Alternatively, however, the detector can be used to sense the current through the high tension lead 24 or the return lead, or even at the igniter itself. Although a toroidal-type current transformer is used herein as the discharge current detector, other detectors could be used. For example, a simple wire detector could be used, such as shown and described in pending U.S. patent application Ser. No. 08/092,146, filed on Jul. 15, 1993, now U.S. Pat. No. 5,508,618 entitled CORELESS DETECTOR FOR IGNITION DISCHARGE CURRENT, and commonly owned by the assignee of the present invention.

As shown in phantom in FIG. 1 herein, such a wire detector 31 as described in the referenced patent application can be used to detect the current discharge pulses at various points or locations in the ignition circuit. In this case, the detector circuit is shown in use detecting the current through a conductor that connects the inductor 22 to the switch 16. Alternatively, however, the wire can be disposed to sense the current through the high tension lead 24 or the return lead 26, or even at the igniter itself. According to an important aspect of the invention, the detector circuit 10 includes a short conductor or wire 31 that is preferably disposed adjacent to the conductor or other current carrying element at the particular location where pulsed current detection is desired. An advantage of the invention is that this pick-up wire can be positioned as desired and easily moved as desired to different locations in the ignition circuit. The wire detector 31 can also be realized as a simple add-on feature for the overall system and engine, rather than needing a specific mounting arrangement as is typical with pulse transformers having cores.

The wire 31 can simply be laid parallel and adjacent to or twisted with the current carrying element of interest, or attached thereto by any convenient means such as a suitable adhesive. This effectively provides an air gap magnetic coupling between the wire 31 and the current carrying element.

Current through the current carrying element induces a sense current in the wire 31 due to the magnetic coupling between the conductors. The diode 34 and the capacitor 38 function as a peak detector for the current induced in the wire 31. The current induced in the wire 31 is sufficient to charge the capacitor to a few volts; for example, with a capacitor value of 0.1 μf and 1 inch wire, a 520 amp discharge can produce a 17 volt output. This output can be used in a manner similar to the output from a current transformer 32 as described hereinafter.

The igniter discharge current pulse detector 32 is connected to the anode of a first sensing diode 34 that has its cathode connected to a node 36. The node 36 is further connected to a storage capacitor 38 ($C_{store}$) and an output switch 40, which in this case is realized in the form of an output transistor. The transistor output thus represents a diagnostic signal 50 that can be used by a monitoring device or other circuitry (not shown) to determine the operating health of the exciter circuit and the igniter.

The value of the storage capacitor 38 is selected so that, if the main capacitance 12 discharges through the igniter in a normal manner, the capacitor 38 is charged to a voltage level that is sufficient to turn on the switch 40 and to keep the switch on for a portion of the discharge cycle, but not so long as to overlap with the next spark discharge. Note that the storage capacitor 38 discharges through a current limiting device 39 such as a resistor or current regulating diode, for example, and the base-emitter junction of the switch 40.

The exciter circuit further includes a discharge resistor 42, sometimes referred to as a quench resistor, connected to the discharge side of the switching device 16. This resistor is provided to discharge the main capacitor 12 in the event that the switching device 16 closes but the igniter 20 fails to produce a spark, e.g. if the igniter plug or lead is open or the plug is quenched due to high combustor pressure in the engine. Quenching of an igniter plug, such as a conventional air gap plug, can be a normal operating condition based on engine speed and combustor pressure. The multistate diagnostic output of the present invention is particularly useful then to detect when quenching occurs.

Another discharge current pulse detector 44 is provided to sense the discharge current through the quench resistor 42. The detector 44 can be the same design as the igniter discharge current detector 32, or a different design as needed for a particular application.

The discharge detector 44 is connected to the anode of a second sensing diode 46, which has its cathode connected to the node 36. The presence of the discharge resistor 42 produces a relatively slow discharge of the main capacitor 12 compared to the discharge of the capacitor 12 through the igniter. As a result, current flow through the resistor 42 causes the capacitor 38 to be charged to a voltage sufficient to keep the transistor 40 on for the entire spark rate cycle. In other words, by the time the control circuit 18 is ready to close the switch 16 for a subsequent spark period, the transistor 40 will still be on.

Note that the first current detector 32 is disposed in such a manner that it only senses the discharge current for an igniter discharge, whereas the second current detector is disposed so as to detect only the discharge of the capacitor 12 through the resistor 42.

In operation, the diagnostic circuit 30 produces a diagnostic signal 50 at the output of the switch 40, which diagnostic signal has multiple states that respectively correspond to the type of discharge. When the discharge occurs through the igniter, the output of the switch 40 pulses for a duration that is shorter than the spark rate cycle (e.g. the duration between sparks). So long as the igniter properly fires, the diagnostic signal is a series of pulses with each pulse corresponding to an igniter discharge. A diagnostics system (FIG. 4) can monitor these pulses and count the total number of igniter discharges (as part of an igniter "life" monitoring function) as well as determine the spark rate based on the time rate of occurrence of the discharges.

If the switch 16 closes but the igniter fails to produce a spark, the diagnostic signal 50, in this case, is latched to a low state for a time period longer than the next expected spark occurrence. Therefore, the monitoring circuit can determine that the igniter failed to fire even though the capacitor apparently was charged and the switch 16 apparently closed properly.

The particular arrangement described by which an igniter discharge produces a pulse output and a non-igniter discharge produces a fixed output are intended to be exemplary. For example, by appropriate selection of component values, the output from an igniter discharge could be a fixed value while a pulse is produced for a non-igniter discharge. This component selection can include using different turns ratios in the current transformers 32,44 so as to induce different voltage signals detected by the diagnostic output signal device 40. The current transformers 32,44 could also be realized in the form of a single device that has two primary windings and one secondary. In such a case, the different turns ratios for the primaries can be selected so that the secondary output corresponds to the type of discharge from the exciter circuit.

As a third operating condition, if the capacitor never charges properly, or if the switch 16 fails to close, then the transistor 40 remains off for the duration of the discharge cycle.

The diagnostic signal 50 thus provides substantial information concerning the type or mode of discharge that occurs, if any, all with the use of a single diagnostic output. As will be explained herein, this single output two wire diagnostic signal can be used by a diagnostics system for modal analysis of the type of discharge as part of an engine and ignition health diagnostics function.

Figure 2:
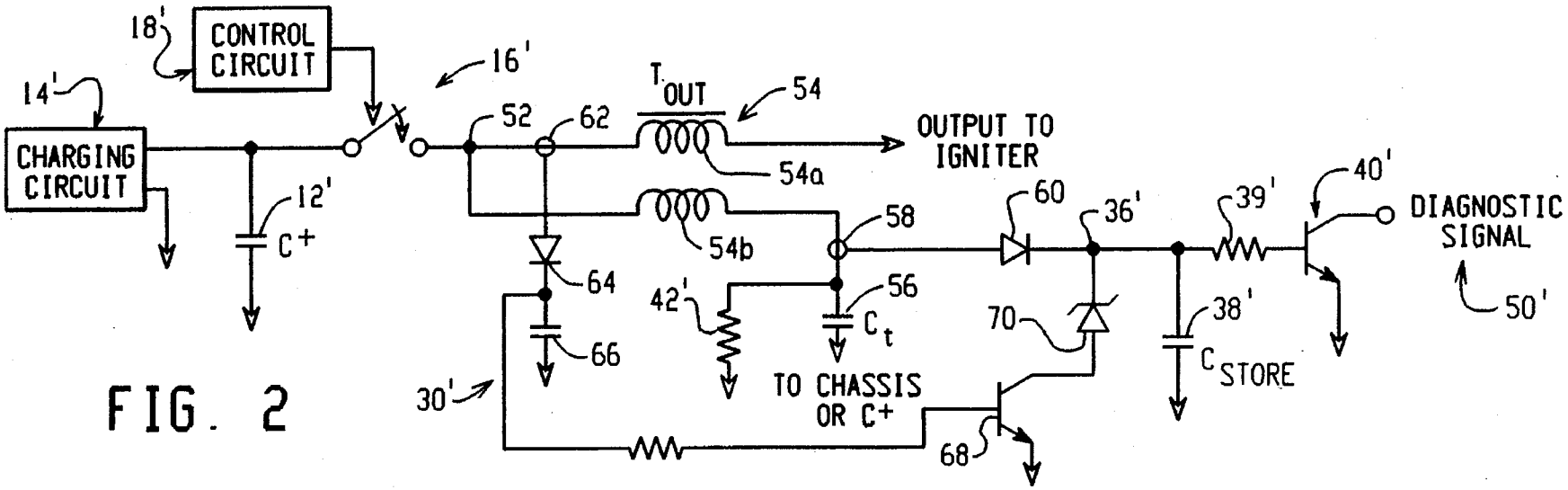
FIG. 2 is an electrical schematic diagram of another embodiment of the invention.

With reference to FIG. 2, another embodiment of the invention is shown, this time in use with a high tension discharge circuit. To the extent that like components are used as already described with respect to the embodiment of FIG. 1, corresponding reference numerals are used followed by a prime (').

Accordingly, the exciter circuit includes a main storage capacitor 12' that is charged by a charging circuit 14'. A switching device 16' may be controlled under operation of a control circuit 18'. The switching device 16' is connected to the secondary and primary windings, such as at node 52, of a step-up transformer 54. The transformer secondary winding **54*a* is connected to the igniter (not shown in FIG. 2), and the primary winding 54*b* is connected to an excitation capacitor 56 ($C_t$). As is well known, the transformer 54 can be used to step-up the initial voltage from the storage capacitor 12' across the igniter plug gap. When the switching device 16' is triggered closed, discharge current from the capacitor 12' initially flows through the primary 54*b* to charge the capacitor 56. During this time, a high voltage spike is induced in the secondary 54*a* that appears across the igniter plug to create a spark. With this spark, the capacitor 12' completes discharge through the secondary winding 54*a***.

A current sensing device 58 (which may be the same design as the sensors 32,44 of FIG. 1) senses the current flow through the primary **54*b*, and is connected to a sensing diode 60. The cathode of the diode 60 is connected to a node 36' commonly connected to a storage capacitor 38' and an output switch 40'. The switch 40' is used to produce a multistate diagnostic signal 50'**.

A second current sensor 62 (again the same current detector design can be used as previously described herein) is used to detect discharge current resulting from an igniter discharge. The detector 62 is connected to a sense diode 64, the cathode of which is connected to a capacitor 66 and a clamping switch 68, such as a transistor. The output of the clamping switch 68 is connected to a zener diode having its cathode connected to the common node 36'.

In operation, when the switch 16' closes, capacitor 56 is charged during the voltage step-up period, and the storage capacitor 38' is also charged to a voltage level sufficient to keep the switch 40' on for the duration of the spark cycle. If the capacitor 12' discharges through the igniter, then the clamp transistor 68 turns on and the zener diode 70 drops the voltage on the storage capacitor 38' to a level that keeps the transistor 40' on for only a portion of the spark cycle. Thus, the diagnostic signal will be a pulse during normal igniter discharge of the exciter circuit, similar to the diagnostic signal produced with the embodiment of FIG. 1.

If the igniter is quenched, or otherwise fails to fire, the clamping transistor 68 does not turn on and the output transistor 40' remains on for the duration of the spark cycle time. If the switch 16' fails or the capacitor 12' never charges, then the transistor 40' remains off for the entire spark cycle.

Thus, the embodiment of FIG. 2 produces a diagnostic signal with a multistate output that corresponds to at least three different exciter circuit and discharge conditions, similar to the embodiment of FIG. 1.

Figure 3:
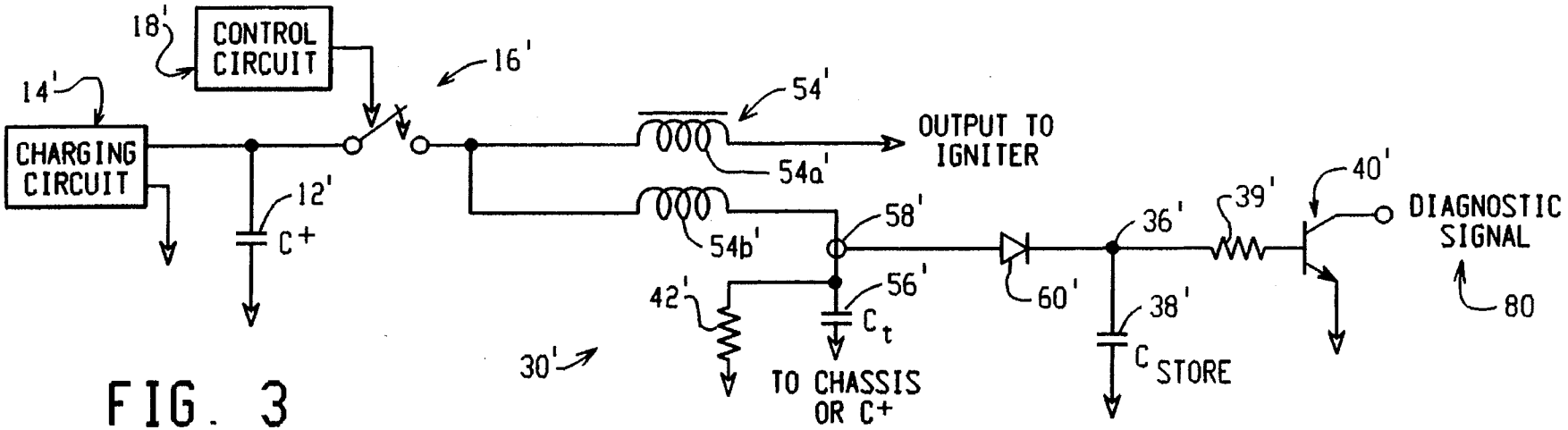
FIG. 3 is an electrical schematic diagram of another embodiment of the invention.

With reference to FIG. 3, another embodiment of the invention is illustrated. The exciter circuit includes a high tension discharge circuit in a manner similar to FIG. 2. Accordingly, there is a main storage capacitor 12' that is charged by a charging circuit 14'. The switching device 16' is connected to a voltage step-up transformer 54'. The primary of the transformer 54' is connected to an energization capacitor 56'.

A discharge current pulse detector 58' is used to sense the current through the capacitor 56'. The detector 58' is connected to a sense diode 60' with its cathode connected to a junction node 36'. The node 36' is connected to a storage capacitor 38' and an output switch 40'. The switch output 80 provides a diagnostic signal that corresponds to the type or mode of discharge that occurs in the exciter circuit.

In operation, the embodiment of FIG. 3 makes use of the fact that the discharge current amplitude and frequency through the capacitor 56' is different for an igniter discharge as compared to a non-igniter discharge. The value of the capacitor 56' and the storage capacitor 38', as well as the turns ratio for the current transformer, can be selected to change the voltage the storage capacitor 38' is charged to dependent on the discharge path.

For example, when the exciter circuit is discharged through the igniter, a short duration current pulse passes through the excitation capacitor 56'. This current can be used to produce a short duration pulse across the capacitor 38' such that the transistor 40' is momentarily turned on for a time period that is short compared to the spark rate. However, when the igniter is quenched, or otherwise fails to fire, the main capacitor voltage is discharged through the discharge resistor 42', a substantially longer duration pulse across the storage capacitor 38' occurs. When no discharge occurs, such as due to a faulty switch 16', the output transistor 40' remains off throughout the spark cycle. Note that the diagnostic signal 80 will essentially emulate the diagnostic signals produced in FIGS. 1 and 2 if the capacitor values are selected such that the transistor 40' on time is longer than the spark rate period for a non-igniter discharge, and the transistor 40' on time is short compared to the spark rate period for an igniter discharge.

In accordance with another aspect of the invention, the diagnostics arrangements are particularly useful, in ignition systems that utilize more than one exciter circuit, to determine when one of the systems fails. The diagnostic output 50 of the failed system will differ from the others, and this difference can be detected by comparing all outputs to one another or to historical events/data. With conventional diagnostics, the only information available is whether the igniter fired or not. With the diagnostics of the present invention, it is possible to determine the type or mode of discharge and to identify which exciter circuit or output is at fault, with only one diagnostic signal per exciter circuit being used.

Figure 4:
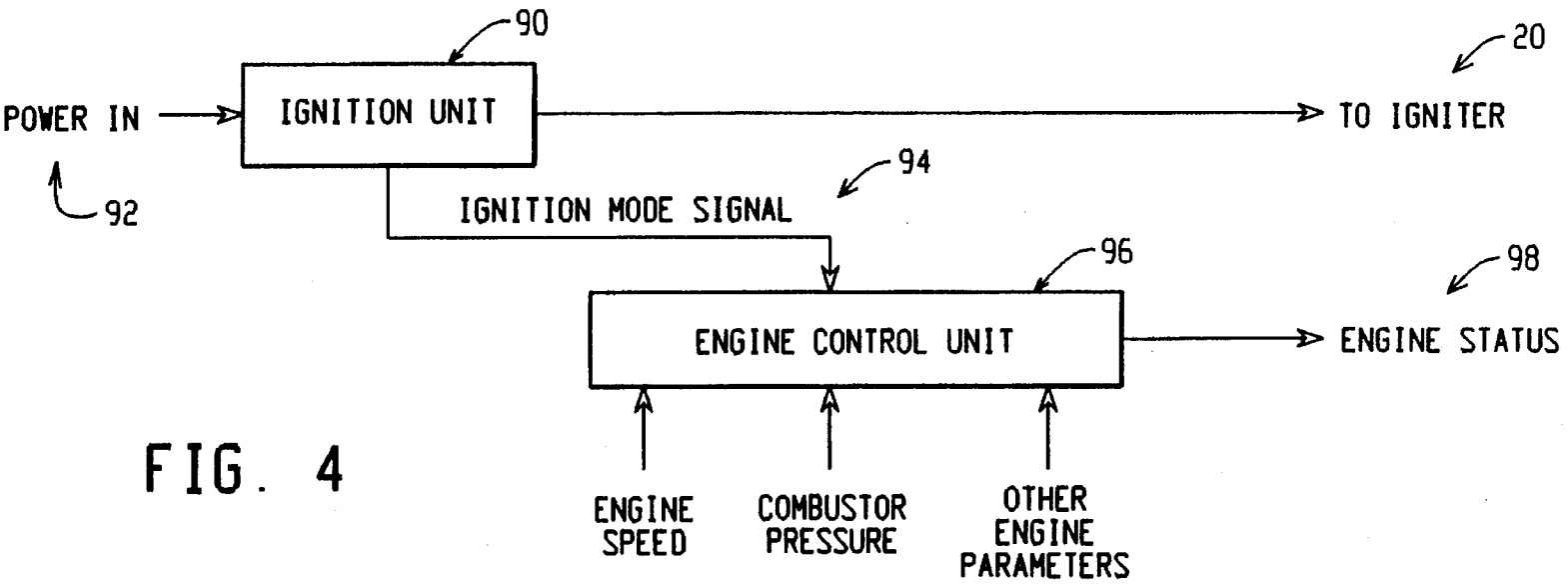
FIG. 4 is a system level functional block diagram of an ignition system diagnostics arrangement that uses the present invention.

With reference to FIG. 4, we show in functional block diagram form how such a diagnostics arrangement can be realized. Specific details of the circuits can be conventional in design. In FIG. 4, we show an arrangement by which an exciter circuit 90 receives power from a source 92 such as the main power plant of an engine. The exciter produces the discharge pulses to the igniter 20, and a diagnostics circuit, such as one of the embodiments of FIGS. 1–3 herein, is used to provide a single output diagnostic signal 94. This diagnostic signal is input to an engine control unit 96, that may also receive engine inputs such as speed, combustor pressure and so on. One or more output signal 98 may be produced to indicate engine status and operation. Although not shown in FIG. 4 for clarity, more than one exciter circuit 90 can be used on an engine.

The control unit 96 can use the discharge mode information to clarify engine ignition health. If the exciter discharge mode changes within the start or operational cycle of the engine are different than anticipated, a determination of good or poor health as well as faults can be determined.

As an example, suppose an engine includes two exciter circuits and that after engine start the control system 96 detects normal discharge (through the igniters) from each exciter using the respective diagnostics signals. As engine speed increases, one of the exciter circuits may indicate quenching at 40% speed—as indicated by a change in the diagnostic signal such as from a pulsed signal to a single state signal. If engine profile history indicates that under the operating conditions at the time of quenching that such quenching should occur at 80% speed, then the control unit 96 can indicate in the engine status output that the system has a potentially worn plug that needs replacement. If igniter operation does not resume when engine speed falls below 40%, then a possible open plug is indicated.

In another example, suppose the control unit turns on two exciter circuits and notes via the diagnostic signals that normal discharge is occurring. As engine speed increases, suppose one igniter quenches as anticipated at 80% speed, but that the other does not quench at all. In this case the control unit 96 can indicate that the cable or plug is shorted in that ignition system. A variation of this example is that if the exciter discharges in a normal manner at low altitude but at high altitude a short is indicated (by no quenching), this would indicate a cable or contact breakdown due to poor sealing of the connectors (causing, for example, arcing).

Thus, the modal analysis available by use of the invention allows fault determination based on more than just a single set of parameters within the exciter itself. This modal analysis can be performed using diagnostic signals that are multistate as described herein, or with the use of separate diagnostic signals for each mode, for example, a separate diagnostic signal that indicates igniter discharge and a separate diagnostic signal that indicates quenching.

The invention thus provides diagnostic circuits and methods for producing a single diagnostic output that indicates igniter discharges for an exciter circuit, as well as exciter circuit discharges other than through the igniter, thus facilitating troubleshooting and analysis.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. Diagnostic apparatus for an ignition system having an exciter circuit connected to discharge through an igniter, comprising: means for detecting a plurality of ignition system discharge conditions including discharge from the exciter circuit through the igniter, discharge from the exciter circuit other than through the igniter, and insufficient discharge of the exciter circuit; and means for producing at a single output a diagnostic signal having at least three states with each state indicative of one of said discharge conditions.

2. The apparatus of claim 1 wherein said conditions correspond to (1) discharge of a main storage capacitor in the exciter circuit through the igniter, (2) discharge of said capacitor through a discharge resistor; and (3) a failure of the exciter circuit to discharge sufficient energy through the igniter.

3. The apparatus of claim 1 wherein said diagnostic signal corresponds to output states of a switching device that include open, closed and pulsed open/closed states.

4. The apparatus of claim 1 wherein said first stated condition is detected by detecting discharge current through the igniter.

5. The apparatus of claim 4 wherein said second stated condition is detected by detecting discharge current through a discharge resistor used to discharge the main storage capacitor when the igniter does not discharge the exciter circuit.

6. The apparatus of claim 4 wherein said second stated condition is detected by detecting current through a step-up transformer.

7. The apparatus of claim 1 wherein said diagnostic signal corresponds to output states of a switching device, said means for producing comprising input control operation of the switching device so that the switching device produces a pulse output state, an open output state and a closed output state, with each output state corresponding respectively to one of said types of exciter circuit discharge.

8. The apparatus of claim 1, wherein said diagnostic signal also indicates a no discharge condition of the exciter circuit.

9. The apparatus of claim 8 wherein there are a plurality of exciter circuits used with an engine, each exciter circuit having a single output diagnostic signal associated therewith, said apparatus further comprising means to compare said diagnostic signals with a known engine profile to determine engine and ignition system performance.

10. The apparatus of claim 1 in combination with a aircraft engine.

11. The apparatus according to claim 1 in combination with a turbine engine.

12. The apparatus of claim 5 wherein said discharge currents are detected using current transformers.

13. The apparatus of claim 1 wherein said single output exhibits a unique output corresponding to each condition of igniter discharge, a quenched igniter, and insufficient discharge of the exciter circuit.

14. The apparatus of claim 1 wherein said diagnostic signal has three states with each said state corresponding to a respective one of said types of discharge, each of said states being represented by a corresponding electrical signal characteristic.

15. The apparatus of claim 14 wherein each said state is represented in the form of a discrete voltage signal.

16. A method for monitoring ignition system operation for an exciter circuit connected to an igniter, comprising the steps of:

a. detecting discharge from the exciter circuit through the igniter;

b. detecting discharge from the exciter circuit other than through the igniter; and c. detecting insufficient discharge of the exciter circuit; and d. producing at a single output a diagnostic signal having at least three states with each state indicative of one of said discharge conditions.

17. The method of claim 16 wherein said discharge detecting steps comprise detecting current flow through the igniter and through a circuit element other than the igniter.

* * * * *